US007383609B2

(12) United States Patent
Ji

(10) Patent No.: US 7,383,609 B2
(45) Date of Patent: Jun. 10, 2008

(54) UPRIGHT TYPE VACUUM CLEANER HAVING MULTI JOINT PORTION

(75) Inventor: Heon-Pyeong Ji, Busan (KR)

(73) Assignee: LG Electronics Inc., Seoul (KR)

( * ) Notice: Subject to any disclaimer, the term of this patent is extended or adjusted under 35 U.S.C. 154(b) by 832 days.

(21) Appl. No.: 10/834,985

(22) Filed: Apr. 30, 2004

(65) Prior Publication Data

US 2005/0125944 A1 Jun. 16, 2005

(30) Foreign Application Priority Data

Dec. 11, 2003 (KR) ..... 10-2003-0090420

(51) Int. Cl.
*A47L 9/32* (2006.01)

(52) U.S. Cl. ..... 15/410; 15/350

(58) Field of Classification Search ..... 15/350, 15/410; 16/429, 900, 324, 326, 352; *A47L 9/32*
See application file for complete search history.

(56) References Cited

U.S. PATENT DOCUMENTS

| | | | | |
|---|---|---|---|---|
| 2,499,330 A * | 2/1950 | Reeves | 15/390 |
| 4,670,937 A * | 6/1987 | Sumerau et al. | 15/410 |
| 5,996,175 A | 12/1999 | Fusco | 15/410 |
| 6,779,229 B2 * | 8/2004 | Lee et al. | 15/410 |
| 7,219,390 B2 * | 5/2007 | Johnson et al. | 15/410 |

FOREIGN PATENT DOCUMENTS

| | | |
|---|---|---|
| JP | 06-062985 | 3/1994 |
| JP | 08-173362 | 7/1996 |
| JP | 08-173363 | * 9/1996 |
| JP | 2001-087187 | 4/2001 |
| KR | 2002-0063450 | 8/2002 |
| KR | 2003-0033774 | 5/2003 |

* cited by examiner

*Primary Examiner*—Theresa T Snider
(74) *Attorney, Agent, or Firm*—Ked & Associates, LLP

(57) ABSTRACT

An upright type vacuum cleaner is provided that includes a main body containing a filtering device that filters out foreign materials entrained in sucked air, a suction nozzle device connected to a lower portion of the main body to be pivoted on a first joint portion, so as to suck the air with the entrained foreign materials and guide the sucked air into the main body, and a handle that is connected to an upper portion of the main body to be pivoted on a second joint portion. The handle is provided with a third joint portion in the middle of the handle so that the handle may be folded at certain angles, and grasped by a user in use. The main body, the suction nozzle device, and the handle are connected to one another through the three joint portions in various configurations and at different angles so that users having various physical conditions may conveniently use the vacuum cleaner in various manners.

19 Claims, 10 Drawing Sheets

Prior-Art

UPRIGHT TYPE VACUUM CLEANER HAVING MULTI JOINT PORTION

BACKGROUND OF THE INVENTION

1. Field of the Invention

The present invention relates to an upright type vacuum cleaner, and more particularly, to an upright type vacuum cleaner, wherein a nozzle unit, a main body and a handle can be used in various configurations and at different angles.

2. Description of the Related Art

FIG. 1 is a rear perspective view showing the structure of a conventional upright type vacuum cleaner. Referring to FIG. 1, the upright type vacuum cleaner roughly comprises a main body 1, a suction nozzle unit 3 and a handle 5. The main body 1 contains a motor for generating suction force sucking foreign materials such as dust, and a filtering means for filtering out the foreign materials entrained in sucked air. A switch 2 is provided at a side of an outer surface of the main body 1 to turn on or off the motor.

The suction nozzle unit 3 is connected to the main body 1 so that the suction nozzle unit can pivot on a shaft with respect to the main body 1 in a predetermined angular range. Accordingly, when not in use, as shown in FIG. 1, the main body 1 maintains an upright state with respect to the suction nozzle unit 3. When in use, the main body 1 is inclined at a certain angle with respect to the suction nozzle unit 3 seated on a place to be cleaned. Here, in order to release the main body 1 from the upright state with respect to the suction nozzle unit 3, a releasing pedal 3' is provided at a rear end of the suction nozzle unit 3.

Meanwhile, the suction nozzle unit 3 serves to suck foreign materials existing on the place to be cleaned together with air. To this end, a suction inlet is formed in a bottom face of the suction nozzle unit 3. The suction inlet communicates with the motor in the main body 1 through a connecting hose 4.

The handle 5 is formed to be elongated at an upper end of the main body 1. When in use, the handle is grasped by a user. The handle 5 is formed integrally with the main body 1.

The suction nozzle unit 3 is provided with wheels 7 for allowing the suction nozzle unit to smoothly move. In addition to the wheels 7, of course, it is preferred that a separate roller be provided on the bottom face of the suction nozzle unit 3. In the figure, reference numeral 9 designates a power cord.

The conventional upright type vacuum cleaner constructed as above is kept in a state where the main body 1 is stood upright with respect to the suction nozzle unit 3 as shown in FIG. 1. When in use, a locking state between the main body 1 and the suction nozzle unit 3 is released by pressing the releasing pedal 3'. Thereafter, the user grasps the handle 5 and can move the suction nozzle unit 3 in a state where the main body 1 is inclined at a certain angle with respect to the suction nozzle unit 3.

When the user then turns on the switch 2 to operate the motor, foreign materials such as dust existing on a place to be cleaned are sucked together with air through the suction inlet of the suction nozzle unit 3 by means of the suction force. The foreign materials and air are sucked through the connecting hose 4 and pass through the filtering means mounted in the main body 1 to filter out the foreign materials. The air from which the foreign materials are filtered out is discharged to the outside of the main body 1.

The conventional vacuum cleaner described above has problems as follows.

That is, in the conventional upright type vacuum cleaner, since the main body 1 can freely pivot at certain angles with respect to the suction nozzle unit 3, the user can perform cleaning work while maintaining an angle formed between the main body and the suction nozzle unit according to the user's physique. However, in a case where the user intends to insert the suction nozzle unit 3 into a place under furniture, particularly, into a farthest place under the furniture, the main body 1 should be significantly lowered and thus the user should considerably bend his/her back.

With such a structure in which only the main body 1 pivots with respect to the suction nozzle unit 3 at certain angles, there is a problem in that users having different physiques cannot conveniently use the vacuum cleaner under various conditions.

Further, since the handle 5 extends upward from the main body 1 and the vacuum cleaner 1 should be kept in a state where the main body maintains an upright state with respect to the suction nozzle unit 3, there is a problem in that an overall height of the vacuum cleaner is excessively large, thereby increasing a space required for keeping the vacuum cleaner.

SUMMARY OF THE INVENTION

Accordingly, the present invention is conceived to solve the problems in the prior art. An object of the present invention is to provide an upright type vacuum cleaner, wherein a nozzle unit, a main body and a handle can be used in various configurations and at different angles.

Another object of the present invention is to provide an upright type vacuum cleaner of which the length and shape can be adjusted according to various physical conditions of users.

A further object of the present invention is to provide an upright type vacuum cleaner, wherein a space required for keeping the vacuum cleaner can be minimized.

According to an aspect of the present invention for achieving the objects, there is provided an upright type vacuum cleaner, comprising a main body with a filtering means for filtering out foreign materials entrained in sucked air; a suction nozzle unit connected to a lower portion of the main body to be pivoted on a first joint portion, so as to suck the air with the entrained foreign materials and guide the sucked air into the main body; a suction force generating means installed at one of the main body and the suction nozzle unit to generate suction force for sucking the air with the entrained foreign materials; and a handle that is connected to the main body to be pivoted on a second joint portion, provided with a third joint portion in the handle so that the handle can be folded at certain angles, and grasped by a user in use.

The first joint portion may be constructed such that the main body and the suction nozzle unit mutually rotate about a first rotational shaft extending in a direction perpendicular to a traveling direction of the suction nozzle unit.

The second joint portion may comprise a connecting piece formed at one of the main body and the handle; a connecting disk formed at the other of the main body and the handle and pivotably connected to the connecting piece; a second rotational shaft simultaneously passing through the connecting piece and the connecting disk to act as the center of relative rotation of the connecting piece and the connecting disk; and a locking means for maintaining a state where the connecting disk has been rotated with respect to the connecting piece.

A pair of connecting pieces may be formed at a predetermined interval.

The locking means may comprise a locking button provided on a side surface of the connecting disk and subjected to elastic force so that the locking button can protrude outward; a fastening bracket that has side plate portions facing both side surfaces of the connecting disk, and a locking button hole in which the locking button is selectively seated, and is fastened between the connecting pieces; and a release button seated in a release button hole formed at a position on the connecting piece corresponding to the locking button hole such that the locking button escapes from the locking button hole when the user presses the release button.

A plurality of locking buttons may be provided at a predetermined angular interval to maintain the second joint portion at different angles.

The third joint portion may comprise a first connecting tube defining a portion of the handle; a second connecting tube that defines a portion of the handle and is connected to the first connecting tube so that it can relatively pivot with respect to the first connecting tube at certain angles; and a locking member for maintaining a state where the second connecting tube has been relatively pivoted with respect to the first connecting tube.

Corresponding ends of the first and second connecting tubes may be provided with a cylindrical connecting/receiving portion and a rotating/connecting portion rotatably received in the connecting/receiving portion, respectively, whereby the second connecting tube is relatively pivoted with respect to the first connecting tube.

The rotating/connecting portion may be formed with a through-hole to communicate with the interiors of the first and second connecting tubes.

The vacuum cleaner may further comprise a joint cover that covers the connecting/receiving portion of the first connecting tube and the rotating/connecting portion of the second connecting tube, and is fixed to one of the first and second connecting tubes.

The locking member may comprise a cylindrical portion in the form of a ring and a skirt portion extending and flaring from the cylindrical portion, and the skirt portion may have locking ribs formed on an inner surface thereof. The locking ribs are fastened to a catching projection provided at one of the first and second connecting tubes at which the locking member is not installed.

The locking member may be urged by an elastic member in a direction in which the locking member is caught by the locking projection, and one end of the elastic member may be supported in cylindrical portion and the other end thereof may be supported by a supporting stopper mounted on an outer circumferential surface of the other of the first and second connecting tubes at which the locking member is installed.

The second and third joint portions may be locked such that the main body and the handle are in a straight line.

According to another aspect of the present invention, there is provided an upright type vacuum cleaner, comprising a suction nozzle unit having a suction inlet in a bottom face thereof to suck air with entrained foreign materials; a main body that is rotatably connected to the suction nozzle unit through a first joint portion such that an obtuse angle is formed between the main body and an upper surface of the suction nozzle unit, and provided with a filtering means for filtering out the foreign materials entrained in the sucked air; a suction force generating portion installed at one of the main body and the suction nozzle unit to generate suction force for sucking the air and the foreign materials; and a handle that is connected to an upper portion of the main body to be pivoted on a second joint portion between a location at which the handle extends from the main body in a straight line and another location at which the handle comes into contact with the main body, provided with a third joint portion in the middle thereof to enable an upper portion of the handle to pivot on the third joint portion with respect to a lower portion thereof in a direction opposite to the pivoting direction of the handle toward the main body, and grasped by a user in use.

According to another aspect of the present invention, there is provided an upright type vacuum cleaner, comprising a main body with a filtering means for filtering out foreign materials entrained in sucked air; a suction nozzle unit connected to a lower portion of the main body to be pivoted on a first joint portion, so as to suck the air with the entrained foreign materials and guide the sucked air into the main body; a suction force generating means installed at one of the main body and the suction nozzle unit to generate suction force for sucking the air with the entrained foreign materials; and a handle connected to the main body to be pivoted on a second joint portion, the handle have prominence and depression which is preventing hand from slipping in a region grasped by a user.

According to the upright type vacuum cleaner of the present invention constructed as above, users having various physiques can conveniently use the vacuum cleaner by adjusting the main body, the suction nozzle unit and the handle in various configurations.

BRIEF DESCRIPTION OF THE DRAWINGS

The above and other objects, features and advantages of the present invention will become apparent from the following description of a preferred embodiment in conjunction with the accompanying drawings, in which.

DETAILED DESCRIPTION OF THE INVENTION

Figure 1:
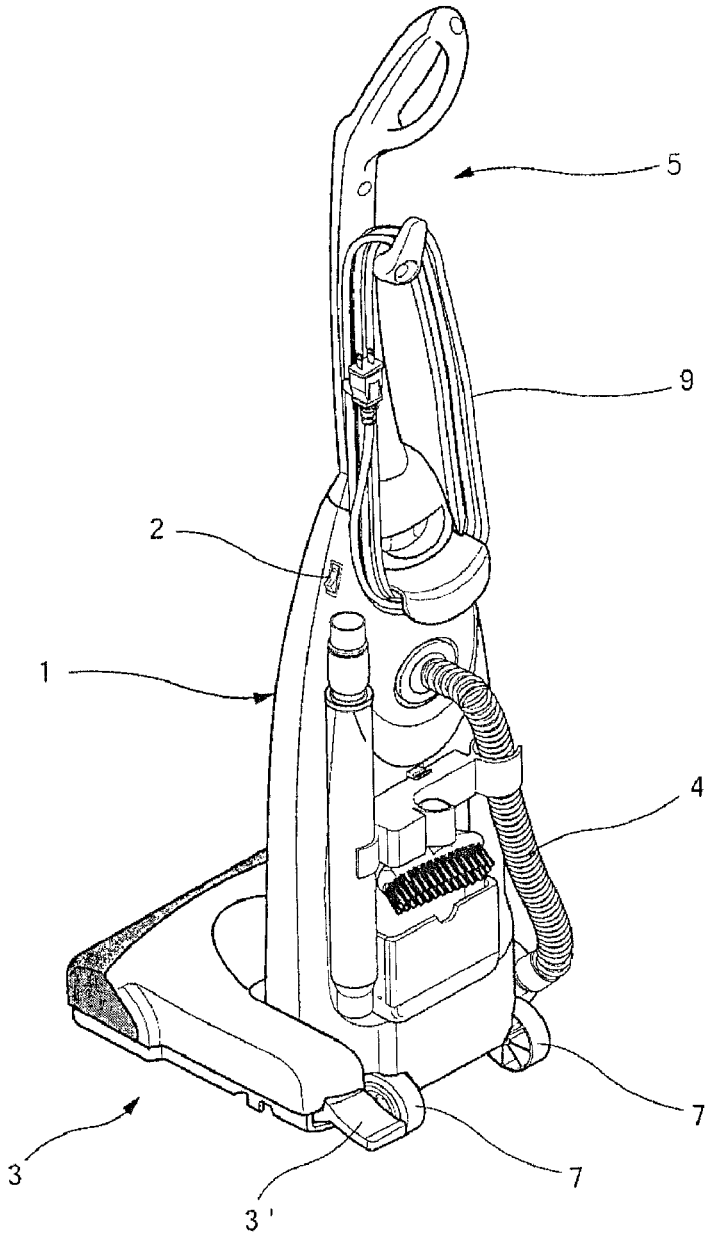
FIG. 1 is a rear perspective view showing the structure of a conventional upright type vacuum cleaner.

Hereinafter, an upright vacuum cleaner according to a preferred embodiment of the present invention will be described in detail with reference to accompanying drawings.

As shown in the figures, the upright type vacuum cleaner of the present invention comprises a main body 10, a suction nozzle unit 20 and a handle 30. The main body 10, the suction nozzle unit 20 and the handle 30 are connected through three joint portions 40, 50 and 60 so that they can be arranged at different angles and then used.

First, the main body 10 contains a motor (not shown) for generating suction force, and a filtering means for filtering out and collecting foreign materials entrained in air sucked by means of the suction force generated by the motor. Of course, the motor is not necessarily contained in the main body 10 but may be provided in the suction nozzle unit 20.

The suction nozzle unit 20 has a suction inlet (not shown) formed in a bottom face thereof to face a place to be cleaned. The suction inlet communicates with the motor in the main body 10 through a connecting hose 22. Therefore, air and the foreign materials are sucked through the suction inlet by means of the suction force generated by the motor and transferred to the filtering means through the connecting hose 22.

The suction nozzle unit 20 is provided with moving wheels 24 for allowing the suction nozzle unit to smoothly move. The wheels 24 are provided at a relatively rear end of the section nozzle unit 20. In addition, at least one roller is provided on the bottom face of the suction nozzle unit 20 to allow the section nozzle unit 20 to more smoothly move.

Figure 3:
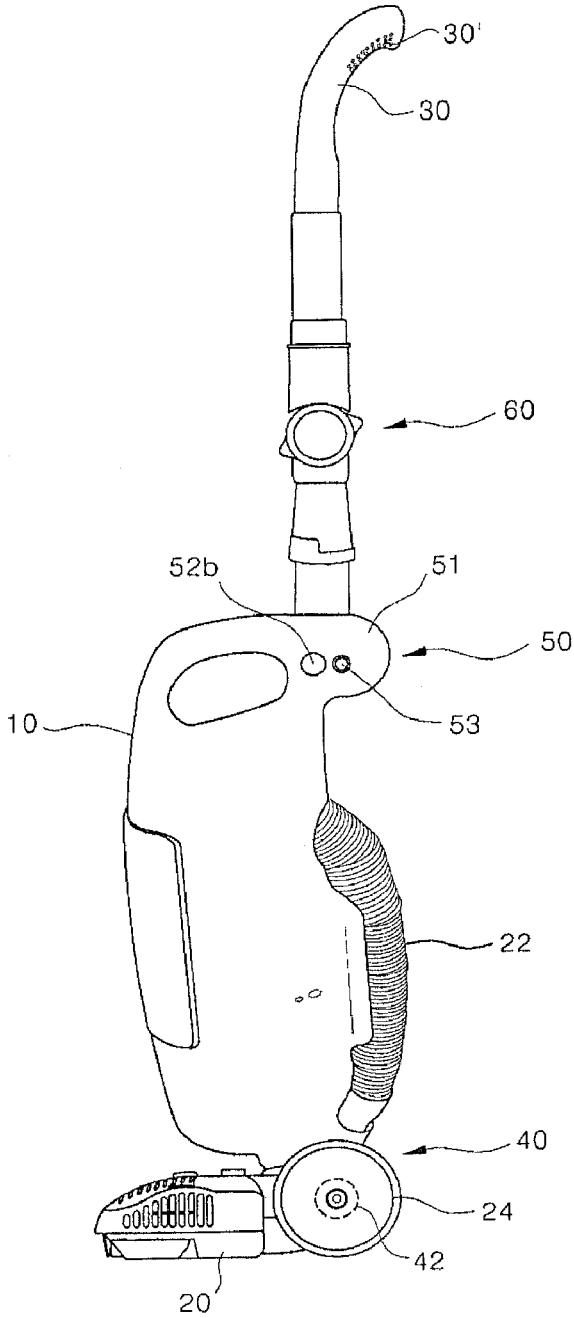
FIG. 3 is a side view showing the structure of the upright vacuum cleaner of the present invention.
Figure 4:
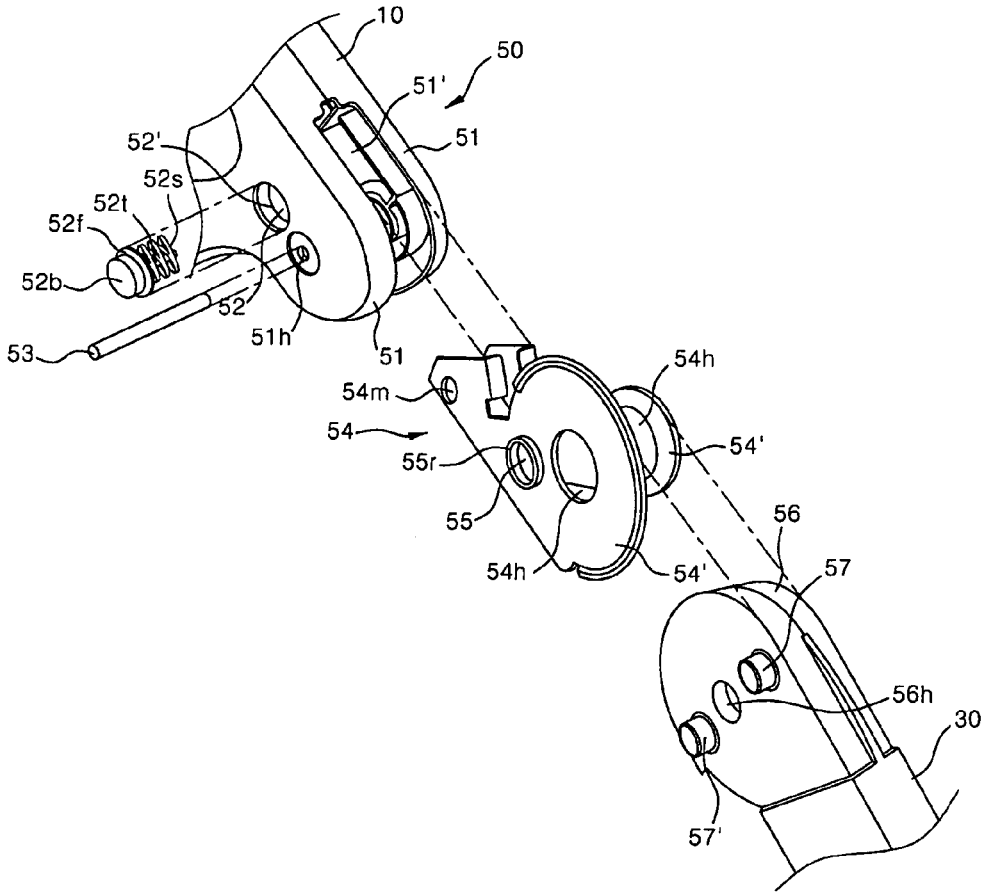
FIG. 4 is an exploded perspective view showing the structure of a second joint portion of the upright vacuum cleaner of the present invention.

The handle 30 is formed to be elongated at an upper end of the main body 10. When in use, the handle is grasped by a user. A region grasped by a user of the handle 30 may be knurled to improve the user's grip. Further, the region grasped by a user of the handle 30 may have a prominence and depression portion 30', as shown in FIG. 3 that correspond to a user's hand. The prominence and depression portion 30' prevents a hand from slipping in a region grasped by a user.

The handle 30 may be folded about the second joint portion 50 at certain angles with respect to the main body 10, and at the same time, about the third joint portion 60 in the middle of the handle at certain angles. The handle 30 may be provided with a switch 32 for turning on or off the vacuum cleaner.

Meanwhile, the main body 10 and the suction nozzle unit 20 are connected to each other through the first joint portion 40. The first joint portion 40 is constructed such that the main body 10 can rotate at certain angles with respect to the suction nozzle unit 20. For example, the first joint portion 40 is provided with a first rotational shaft 42 at a side of a lower end of the main body 10 to extend in a direction perpendicular to a traveling direction of the suction nozzle unit 20, and both ends of the rotating shaft 42 is rotatably mounted at the suction nozzle unit 20.

Next, the structure of the second joint portion 50 for connecting the handle 30 to the main body 10 will be described. Connecting pieces 51 spaced apart at a predetermined interval from each other are provided at the upper end of the main body 10. A space defined between the connecting pieces 51 is a connecting slot 51' in which a connecting disk 56 to be described later is installed rotatably. Shaft holes **51*h* are formed in the both connecting pieces 51**.

One of the connecting pieces 51 has a release button hole 52 formed at a side of an outer surface of the connecting piece adjacent to the relevant shaft hole **51*h*. A cylindrical guide rib 52' is formed on an inner surface of the release button hole 52 such that an inner diameter of the guide rib 52' is somewhat larger than that of the release button hole 52**.

A release button **52*b* is placed in the release button hole 52. The release button 52 serves to press a locking button 57 or 57' to be described later to release a locking state. A flange 52*f* is formed along an outer circumferential surface of a rear end of the release button 52*b*. The flange 52*f* is formed such that its diameter substantially conforms to the inner diameter of the guide rib 52'. Therefore, the flange 52*f* is caught by an inner edge of the release button hole 52 to prevent the release button 52*b* from escaping from the release button hole 52**.

A release protrusion **52*t* is formed to protrude rearward from a rear end surface of the release button 52*b*. The release protrusion 52*t* comes into contact with and then presses the locking button 57 or 57' to be described later. The release button 52*b* is supported by a spring 52*s*** that always urges the release button outward.

A central shaft 53 is installed to pass through the shaft holes 51 of the connecting pieces 51. The central shaft 53 does not actually rotate and acts as the center of rotation of the connecting disk 56 to be described later.

A fastening bracket 54 is provided within the connecting slot 51'. The fastening bracket 54 is provided with side plate portions 54' that will be placed inside of the respective connecting pieces 51. The side plate portions 54' are spaced apart from each other with a gap corresponding to the width of the connecting slot 51' but connected to each other at one ends thereof. Each of the side plate portions 54' has a shaft hole **54*h* that is concentric with the shaft hole 51*h***.

One of the side plate portions 54' is formed with a locking button hole 55 at a position corresponding to the release button hole 52. The release protrusion **52*t* of the release button 52 comes into contact with the locking button 57 or 57' through the locking button hole 55. The locking button hole 55 also has a guide rib 55*r* formed therearound. An inner circumferential surface of the spring 52*s* is seated on an outer circumferential surface of the guide rib 55*r***.

The connecting disk 56 is provided at one end of the handle 30. The connecting disk 56 is inserted into the connecting slot 51' and has a shaft hole **56*h* formed therethrough at the center thereof. The central shaft 53 is received in the shaft hole 56*h*. That is, the central shaft 53 passes through the shaft hole 56*h* of the connecting disk 56 and the shaft hole 54*h* of the fastening bracket 54 and both ends of the central shaft are received in and supported by the shaft holes 51 of the connecting pieces 51**.

The connecting disk 56 has the locking buttons 57 and 57'. The locking buttons 57 and 57' are supported by a spring (not shown) that urges the locking buttons to protrude beyond an outer surface of the connecting disk 56. Accordingly, the locking buttons 57 and 57' always protrude beyond the outer surface of the connecting disk 56 by a predetermined height. When the connecting disk 56 is rotated, the locking button hole 55 is located on a moving path of the locking buttons 57 and 57'.

Figure 2:
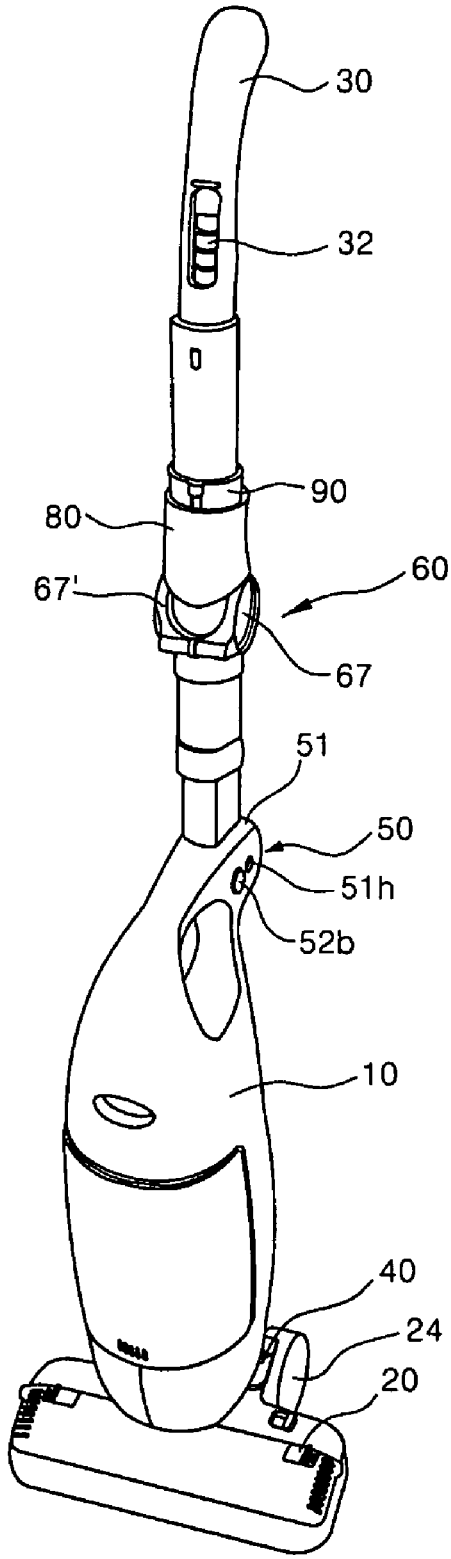
FIG. 2 is a perspective view showing the structure of an upright vacuum cleaner according to a preferred embodiment of the present invention.

In this embodiment, the locking buttons 57 and 57' are located at an angular interval of 180 degrees around the shaft hole **56*h*. However, a plurality of locking buttons should be provided in order to fix the handle 30 at different angles with respect to the main body 10. Since the two locking buttons 57 and 57' are provided in this embodiment, one of the locking buttons 57 and 57' is locked in the locking button hole 55 in a state of FIG. 2 where the handle 30 is in alignment with the main body 10. In a state where the handle 30 is folded to lie on the back of the main body 10, the other of the locking buttons 57 and 57' is locked in the locking button hole 55**.

Figure 5:
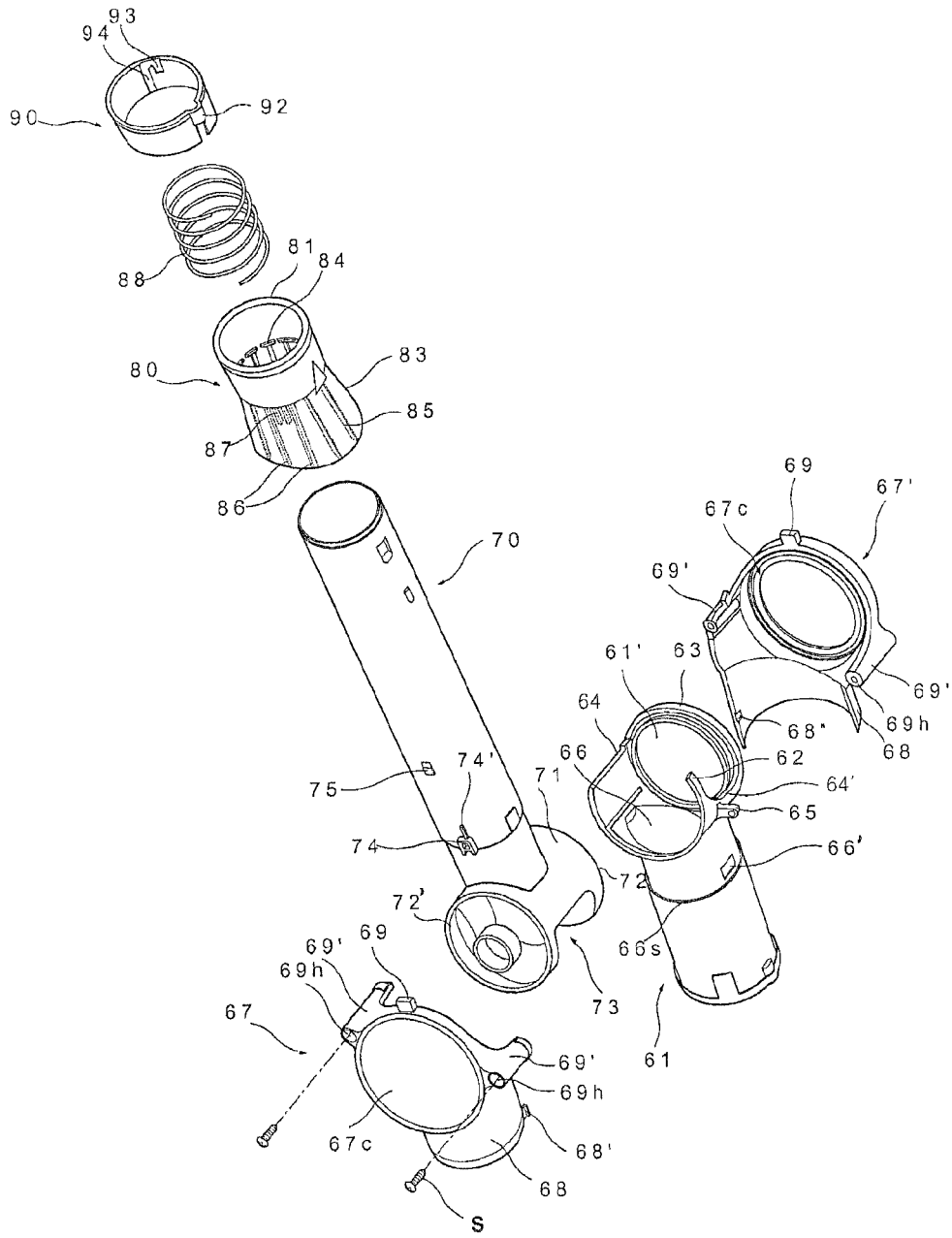
FIG. 5 is an exploded perspective view showing the structure of a third joint portion of the upright vacuum cleaner of the present invention.

Next, the structure of the third joint portion 60 will be described with reference to FIG. 5. The third joint portion 60 allows the handle itself 30 to be folded at certain angles. To this end, a first connecting tube 61 connected to the connecting disk 56 is provided. A connecting/receiving portion 61' is formed at an upper end of the first connecting tube 61. The connecting/receiving portion 61' generally takes the shape of a cylinder of which a portion is cut away in a longitudinal direction thereof.

An escape preventing piece 62 is formed at the connecting/receiving portion 61' to encompass a portion of a rotating body 72 to be described later. The escape preventing piece 62 forms a part of the cylindrical connecting/receiving portion 61'. A guide groove for guiding a side of the rotating body 72 is formed in a disk-shaped sidewall 63 which defines a side of the connecting/receiving portion 61'.

The connecting/receiving portion 61' has a generally linear supporting end 64 formed at a side opposite to the escape preventing piece 62, and a circular supporting end 64' is formed on the side of the escape preventing piece 62. These supporting ends 64 and 64' regulates a range of rotation of a rotating/connecting portion 71 to be described later.

Connecting pieces 65 protrude from an outer surface of the connecting/receiving portion 61' in the vicinity of the circular supporting end 64'. A through-hole is formed through each connecting piece 65. A through-hole 66 is formed through the first connecting tube 61. For example, a power cable goes through the through-hole 66. Reference numeral 66' designates an assembling recess, and reference numeral 66*s* designates a step formed on an outer surface of the first connecting tube 61.

Joint covers 67 and 67' define an external appearance of the third joint portion 60. The joint covers 67 and 67' are formed to be substantially symmetric and coupled with each other by means of screws S. Each of the joint covers 67 and 67' has a circular side cap 67*c*. The side caps 67*c* correspond to the center of rotation of the third joint portion 60.

A binding portion 68 encompassing the first connecting tube 61 is formed at a side of each of the joint covers 67 and 67'. The binding portions 68 of the joint covers 67 and 67' are coupled to encompass a portion of the first connecting tube 61 between the connecting/receiving portion 61 and the step 66*s*.

For the coupling of the binding portions 68 to each other, hooking ribs 68' and seating recesses 68" are provided at corresponding positions, respectively. A portion of each hooking rib 68' protruding toward the interior of the binding portion 68 is seated in the relevant seating recess 68". A catching projection 69 is formed at each of the joint covers 67 and 67'. The catching projections 69 are provided for fastening with a locking member 80 to be described later.

To ensure the coupling of the joint covers 67 and 67', fastening ribs 69' are formed at positions corresponding to each other. Two fastening ribs 69' are formed at each of the joint covers 67 and 67'. A fastening hole 69*h* is formed to penetrate through each fastening rib 69'. For reference, each connecting piece 65 is placed between the relevant two fastening ribs 69', and a fastening screw S passes through the fastening holes 69*h* of the fastening ribs 69' and the through-hole of the connecting piece 65.

A second connecting tube 70 is rotatably connected to the first connecting tube 61. A rotating/connecting portion 71 is formed at a lower end of the second connecting tube 70. The rotating/connecting portion 71 is rotatably received in the connecting/receiving portion 61' and generally takes the shape of a cylinder. Circular ribs 72' in the form of a ring are formed at both ends of the rotating/connecting portion 71 so that the rotation of the rotating/connecting portion can be guided along the guide grooves of the side caps 67*c*.

The rotating/connecting 71 is also provided with a through-hole 73 that communicates with the interior of the second connecting tube 70. Accordingly, the interiors of the first and second connecting tubes 61 and 70 communicate with each other though the through-hole 73 and the power cable and the like can go through them.

A locking projection 74 for fastening with the locking member 80 is formed on an outer circumferential surface of the second connecting tube 70. An auxiliary projection 74' is formed on the outer circumferential surface of the second connecting tube 70 to extend from the locking projection 74 in a longitudinal direction of the second connecting tube 70. Further, a fixing rib 75 is formed on the outer circumferential surface of the second connecting tube 70. The fixing rib 75 is to fix a supporting stopper 90 to be described later.

The locking member 80 surrounds the outer circumferential surface of the second connecting tube 70 and is coupled selectively with the first connecting tube 61, more specifically, the joint covers 67 and 67' to ensure a coupled state of the third joint portion 60. The locking member 80 comprises a cylindrical portion 81 in the form of a ring having an inner diameter larger than an outer diameter of the second connecting tube 70, and a skirt portion 83 that flares from the cylindrical portion 81 toward a lower end of the locking member. The skirt portion 83 is formed to gradually flare toward the lower end of the locking member, and the locking member has different lengths from the cylindrical portion 81 to the lower end of the locking member according to positions in order to prevent the skirt portion from interfering with the joint covers 67 and 67'.

Supporting projections 84 are formed on an inner circumferential surface of the cylindrical portion 81 in the vicinity of the skirt portion 83. The supporting projections 84 are formed along the inner circumferential surface of the cylinder portion 81 to support an end of an elastic member 88 to be described later.

A plurality of spacer ribs 85 are formed on an inner surface of the skirt portion 83. The spacer ribs 85 are to enable relative reduction in a space between the inner surface of the skirt portion 83 and the outer circumferential surface of the second connecting tube 70. Accordingly, the height of the spacer ribs 85 increases gradually toward the end of the skirt portion 83.

The inner circumferential surface of the skirt portion 83 is formed with a pair of locking ribs 86 in a longitudinal direction of the skirt portion 83. The locking ribs 86 are formed parallel to each other with an interval corresponding to the width of the locking projection 74. A pair of auxiliary locking ribs 87 are formed at a position on the inner circumferential surface of the skirt portion that is close to the cylindrical portion 81 and falls within the width of the locking projections 74. The auxiliary locking ribs 87 are formed parallel to each other with an interval corresponding to the width of the auxiliary projection 74'.

The elastic member 88 is provided between the inner circumferential surface of the cylindrical portion 81 and the outer circumferential surface of the second connecting tube 70. The elastic member 88 exerts elastic force in a direction in which the locking member 80 is hung over the joint covers 67 and 67'.

The supporting stopper 90 supports the other end of the elastic member 88 of which one end is supported on the locking member 80. The supporting stopper 90 takes the shape of a ring and is installed to surround the outer circumferential surface of the second connecting tube 70. A restricting projection 92 is formed at a side of the supporting stopper 90 to prevent the locking member 80 from being moved beyond the supporting stopper 90. Of course, since the elastic member 88 is supported by the supporting stopper 90, the locking member 80 is further prevented from being moved toward the supporting stopper 90 beyond a predetermined range.

A fixing recess 93 is formed on an inner surface of the supporting stopper 90. The fixing rib 75 is seated in the fixing recess 93 so that the supporting stopper 90 is fixed to the second connecting tube 70. An insertion groove 94 serving as a path through which the fixing rib 75 is inserted into the fixing recess 93 is formed on the inner surface of the supporting stopper 90. The insertion groove 94 is originated at an end of the supporting stopper which is opposite to the fixing recess 93 and then communicates with the fixing recess 93. The fixing recess 93 is open toward the other end of the supporting stopper which is opposite to the end thereof supporting the elastic member 88.

Hereinafter, the operation of the upright type vacuum cleaner according to the present invention constructed as above will be described in detail.

Figure 6A:
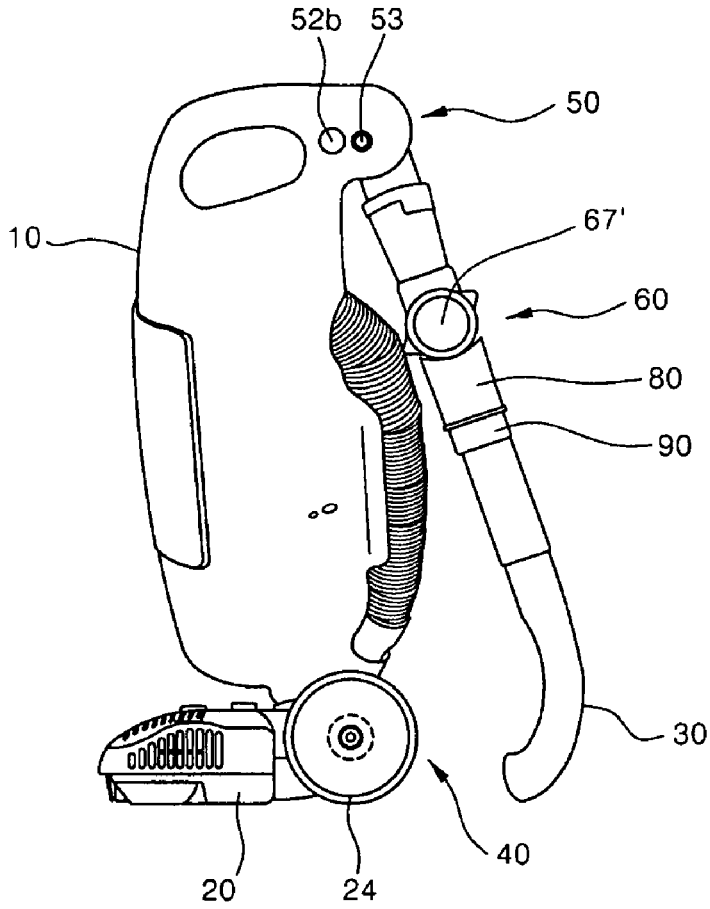
FIGS. 6*a* to 6*e* are views showing states where the upright vacuum cleaner of the present invention is used.

FIGS. 6*a* to 6*e* show various states where the vacuum cleaner of the present invention is used. First, FIG. 6*a* shows a state where the vacuum cleaner of the present invention is in safekeeping. At this time, the main body 10 is stood upright with respect to the suction nozzle unit 20, and the handle 30 is folded back toward the main body 10.

Figure 6B:
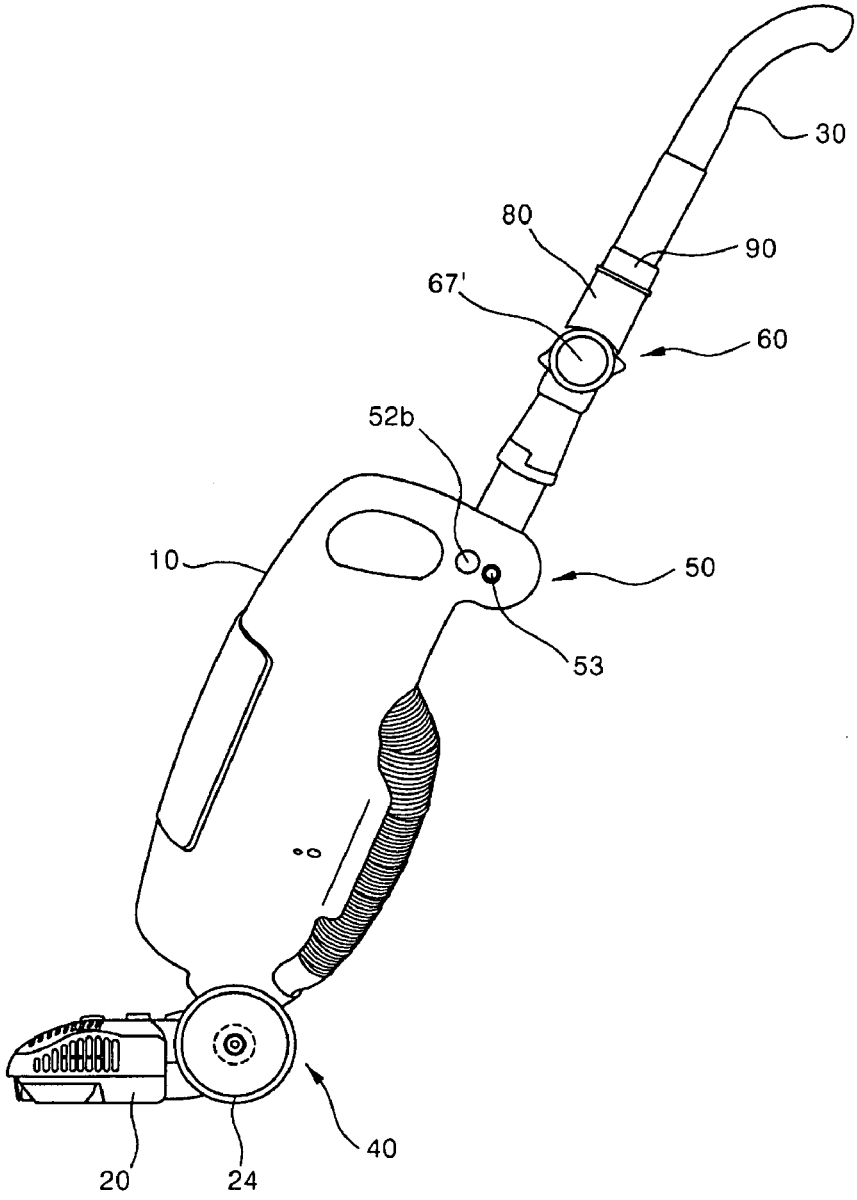

Next, FIG. 6*b* shows a state where the handle 30 is unfolded so that the handle 30 and the main body 10 are in a straight line. At this time, the main body 10 is pivoted on the first joint portion 40 at a certain angle with respect to the suction nozzle unit 20. The locking button 57 is received in the locking button hole 55 so that the handle 30 is in a locked state. This state corresponds to a case where a relatively tall user cleans an open place to be cleaned.

Figure 6C:
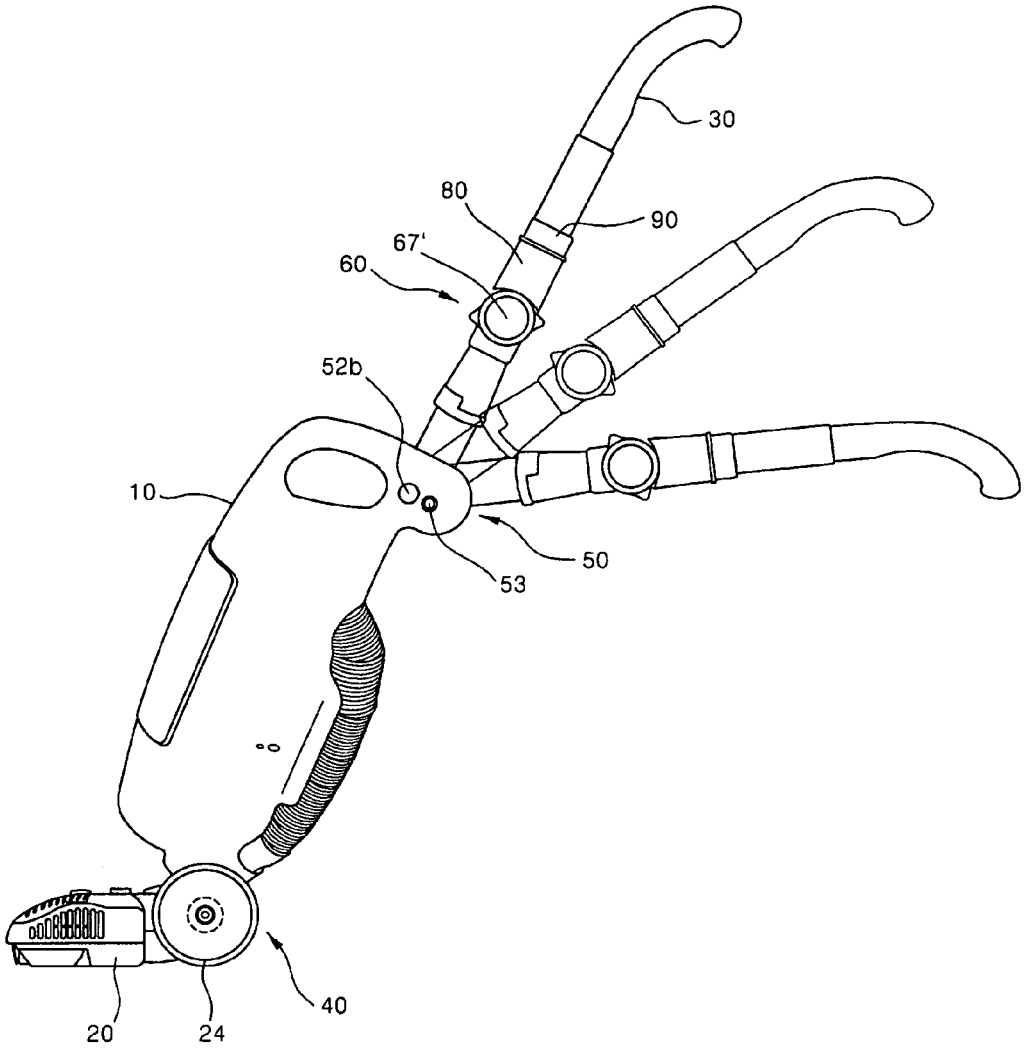

FIG. 6*c* shows a state where the handle 30 is pivoted on the second joint portion 50 at certain angles with respect to the main body 10. That, if the release button 52*b* is pressed in the state shown in FIG. 6*b*, the release protrusion 52*t* presses the locking button 57 received in the locking button hole 55 through the release button hole 52. Accordingly, the locking button 57 escapes from the locking button hole 55, and the fastened state of the connecting disk 56 and the fastening bracket 54 is released. For reference, the locking buttons 57 and 57' which are not received in the locking button hole 55 are pressed by the side plate portion 54' of the fastening bracket 54 and remain within the connecting disk 56.

Therefore, the handle 30 can be freely pivoted on the second joint portion 50 with respect to the main body 10. Of course, if the number of the locking buttons 57 and 57' is increased, the handle 30 can be fixed at different angles with respect to the main body 10.

Meanwhile, if force applied by a user is removed, the release button 52*b* protrudes to the exterior of the connecting piece 51 through the release button hole 52 by means of restoring force of the spring 52*s*. The release button 52 does not escape from the release button hole 52 due to the flange 52*f*.

Figure 6D:
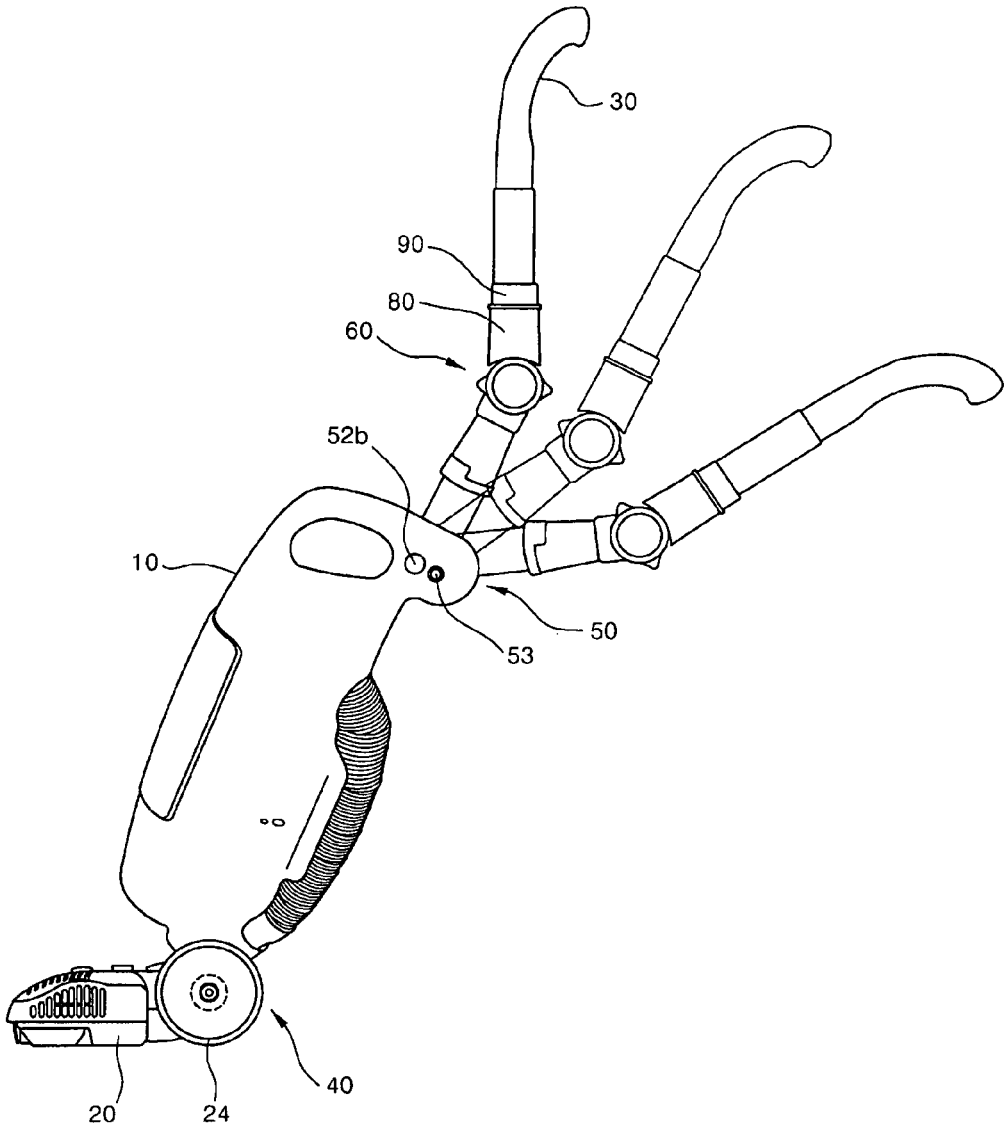

Next, the pivoting of the handle 30 at different angles on the third joint portion 60 provided in the handle 30 will be described. FIG. 6*d* shows a state where the handle 30 is pivoted on the third joint portion 60.

Prior to description of the operation of the third joint portion 60, a state where the third joint portion 60 is assembled will be first described. In a state where the first connecting tube 61 and the second connecting tube 70 are in a straight line, the locking member 80 is pushed toward the joint covers 67 and 67' by means of elastic force of the elastic member 88. Accordingly, the locking projection 74 and the catching projection 69 are located between the locking ribs 86, and the auxiliary projection 74' is inserted between the auxiliary locking ribs 87. In this state, the locking member 80 located around the second connecting tube 70 is fastened to the joint covers 67 and 67' on the first connecting tube 61 so that the second connecting tube 70 cannot relatively rotate with respect to the first connecting tube 61.

In order to ensure the occurrence of pivoting on the third joint portion 60, the locking member 80 should be moved along the second connecting tube 70 toward the supporting stopper 90. That is, when the locking member 80 is moved while overcoming the elastic force of the elastic member 88, the locking ribs 86 of the locking member 80 are released from the catching projection 69 and the auxiliary locking ribs 87 are released from the auxiliary projection 74' so that the first connecting tube 61 can be relatively pivoted with respect to the second connecting tube 70. That is, the rotating/connecting portion 71 can be relatively rotated within the connecting/receiving portion 61'.

For reference, in order to allow the third joint portion 60 to fix the second connecting tube 70 to the first connecting tube 61 as shown in FIG. 6*d*, an additional catching projection 69 may be further provided. That is, the additional catching projection 69 is formed at a position on the joint cover 67 that corresponds to the locking ribs 86 of the skirt portion 83 in the state shown in FIG. 6*d*.

Figure 6E:
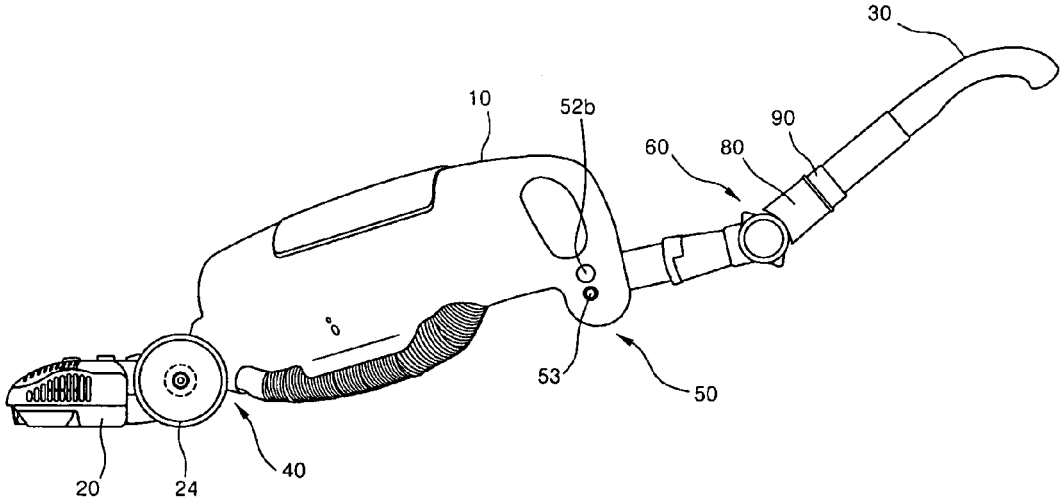

Meanwhile, in the embodiment of the present invention, if the user causes the main body 10 to be closest to a floor and the second connecting tube 70 to be maximally pivoted on the third joint portion 60 as shown in FIG. 6*e*, the user can move the suction nozzle unit 20 to a farthest inner position through a narrow gap. For example, the user can move the suction nozzle unit 20 to a farthest inner position through a gap between the floor and furniture.

If the second connecting tube 70 that has been folded with respect to the first connecting tube 61 is then unfolded to be in line with the first connecting tube 61, the locking member 80 is moved toward the joint covers 67 and 67' by the elastic force of the elastic member 88. Therefore, the locking member 80 is fastened to the joint covers 67 and 67' by means of the locking ribs 86 and the catching projection 69.

The scope of the present invention is not limited to the embodiment described above but defined only by the appended claims. It is obvious that those skilled in the art can make various changes and modifications thereto without departing from the scope of the present invention defined by the claims.

For example, the first to third joint portions 40, 50 and 60 may have structures different from those of the embodiment described and illustrated above. That is, an additional shaft perpendicular to the first rotational shaft 42 of the first joint portion 30 may be provided and the main body 10 may be constructed to rotate about the additional shaft.

As for the second joint portion 50, a plurality of locking buttons may be provided so that the second joint portion 50 can be fixed at different angles, and the connecting pieces 51 and the connecting disk 56 may be provided at mutually opposite positions contrary to the embodiment.

As for the third joint portion 60, the connecting/receiving portion 61' may be formed at the second connecting tube 70, and the rotating/connecting portion 71 may be formed at the first connecting tube 61. Further, a plurality of catching projections 69 for fastening the locking member 80 to the joint covers 67 and 67' may be provided.

According to the upright type vacuum cleaner of the present invention specifically described above, the following advantages can be obtained.

Since the main body, the suction nozzle unit and the handle constituting the vacuum cleaner of the present invention are connected to one another through three joint portions, they can be arranged in various configurations and at different angles. Accordingly, there is an advantage in that users can conveniently use the vacuum cleaner according to users' physical conditions and environments of places to be cleaned.

Further, since the vacuum cleaner of the present invention has relatively many joint portions, there is an advantage in that the vacuum cleaner can be folded to a minimum size for safekeeping so that a space required for keeping the vacuum cleaner can be minimized.

What is claimed is:

1. An upright type vacuum cleaner, comprising:

a main body with a filtering device that filters out foreign materials entrained in sucked air;

a suction nozzle device connected to a lower portion of the main body to be pivoted on a first joint portion;

a suction force generating device mounted in one of the main body and the suction nozzle device to generate suction force for sucking the air with the entrained foreign materials; and a handle connected to the main body to be pivoted on a second joint portion, and provided with a third joint portion in the handle so that the handle can be folded at certain angles, wherein the handle is configured to be grasped by a user in use, and wherein the second joint portion comprises:

a connecting piece formed on one of the main body and the handle;

a connecting disk formed on the other of the main body and the handle and pivotably connected to the connecting piece;

a second rotational shaft simultaneously passing through the connecting piece and the connecting disk to act as a center of relative rotation of the connecting piece and the connecting disk; and a locking device that maintains a state in which the connecting disk has been rotated with respect to the connecting piece.

2. The upright type vacuum cleaner as claimed in claim 1, wherein the first joint portion is constructed such that the main body and the suction nozzle device mutually rotate about a first rotational shaft extending in a direction perpendicular to a traveling direction of the suction nozzle device.

3. The upright type vacuum cleaner as claimed in claim 2, wherein a pair of connecting pieces are formed at a predetermined interval.

4. The upright type vacuum cleaner as claimed in claim 1, wherein the locking device comprises:

a locking button provided on a side surface of the connecting disk and subjected to elastic force so that the locking button can protrude outward;

a fastening bracket having side plate portions facing both side surfaces of the connecting disk, and a locking button hole in which the locking button is selectively seated, the fastening bracket being fastened between the connecting pieces; and a release button seated in a release button hole formed at a position on the connecting piece corresponding to the locking button hole such that the locking button escapes from the locking button hole when the user presses the release button.

5. The upright type vacuum cleaner as claimed in claim 4, wherein a plurality of locking buttons are provided at a predetermined angular interval to maintain the second joint portion at different angles.

6. The upright type vacuum cleaner as claimed in claim 1, wherein the third joint portion comprises:

a first connecting tube that defines a portion of the handle;

a second connecting tube that defines a portion of the handle, the second connecting tube being connected to the first connecting tube so as to relatively pivot with respect to the first connecting tube at certain angles; and a locking member that maintains a state in which the second connecting tube has been relatively pivoted with respect to the first connecting tube.

7. The upright type vacuum cleaner as claimed in claim 6, wherein corresponding ends of the first and second connecting tubes are provided with a cylindrical connecting/receiving portion and a rotating/connecting portion rotatably received in the connecting/receiving portion, respectively, whereby the second connecting tube is relatively pivoted with respect to the first connecting tube.

8. The upright type vacuum cleaner as claimed in claim 7, wherein the rotating/connecting portion is formed with a through-hole to communicate with the interiors of the first and second connecting tubes.

9. The upright type vacuum cleaner as claimed in claim 7, further comprising a joint cover that covers the connecting/receiving portion of the first connecting tube and the rotating/connecting portion of the second connecting tube, the joint cover being fixed to one of the first and second connecting tubes.

10. The upright type vacuum cleaner as claimed in claim 6, wherein the locking member comprises a cylindrical portion in the form of a ring and a skirt portion extending and flaring from the cylindrical portion, and the skirt portion has locking ribs formed on an inner surface thereof, the locking ribs being fastened to a catching projection provided at one of the first and second connecting tubes at which the locking member is not installed.

11. The upright type vacuum cleaner as claimed in claim 10, wherein the locking member is urged by an elastic member in a direction in which the locking member is caught by the catching projection, and one end of the elastic member is supported in cylindrical portion and the other end thereof is supported by a supporting stopper mounted on an outer circumferential surface of the other of the first and second connecting tubes at which the locking member is installed.

12. The upright type vacuum cleaner as claimed in claim 1, wherein the second and third joint portions are locked such that the main body and the handle are in a straight line.

13. An upright type vacuum cleaner, comprising:

a suction nozzle device having a suction inlet in a bottom face thereof to suck air with entrained foreign materials;

a main body rotatably connected to the suction nozzle device through a first joint portion such that an obtuse angle is formed between the main body and an upper surface of the suction nozzle device, and provided with a filtering device that filters out the foreign materials entrained in the sucked air;

a suction force generating portion mounted in one of the main body and the suction nozzle device to generate suction force for sucking the air and the foreign materials; and a handle connected to an upper portion of the main body to be pivoted on a second joint portion between a location at which the handle extends from the main body in a straight line and another location at which the handle comes into contact with the main body, the handle being provided with a third joint portion in the middle thereof to enable an upper portion of the handle to pivot on the third joint portion with respect to a lower portion thereof in a direction opposite to the pivoting direction of the handle toward the main body, wherein the handle is configured to be grasped by a user in use, and wherein the second joint portion comprises:

a connecting piece formed on one of the main body and the handle;

a connecting disk formed on the other of the main body and the handle and pivotably connected to the connecting piece;

a second rotational shaft simultaneously passing through the connecting piece and the connecting disk to act as a center of relative rotation of the connecting piece and the connecting disk; and a locking device that maintains a state in which the connecting disk has been rotated with respect to the connecting piece.

14. An upright type vacuum cleaner, comprising:

a main body with a filtering device that filters out foreign materials entrained in sucked air;

a suction nozzle device connected to a lower portion of the main body to be pivoted on a first joint portion, so as to suck the air with the entrained foreign materials and guide the sucked air into the main body;

a suction force generating device mounted in one of the main body and the suction nozzle device to generate suction force for sucking the air with the entrained foreign materials; and a handle connected to the main body to be pivoted on a second joint portion, wherein the handle has a prominence and depression portion that prevents a hand from slipping in a region grasped by a user, and wherein the second joint portion comprises:

a connecting piece formed on one of the main body and the handle;

a connecting disk formed on the other of the main body and the handle and pivotably connected to the connecting piece;

a second rotational shaft simultaneously passing through the connecting piece and the connecting disk to act as a center of relative rotation of the connecting piece and the connecting disk; and a locking device that maintains a state in which the connecting disk has been rotated with respect to the connecting piece.

15. An upright type vacuum cleaner, comprising:

a main body with a filtering device that filters out foreign materials entrained in sucked air;

a suction nozzle device connected to a lower portion of the main body to be pivoted on a first joint portion;

a suction force generating device mounted in one of the main body and the suction nozzle device to generate suction force for sucking the air with the entrained foreign materials; and a handle connected to the main body to be pivoted on a second joint portion, and provided with a third joint portion in the handle so that the handle can be folded at certain angles, wherein the handle is configured to be grasped by a user in use, and wherein the third joint portion comprises:

a first connecting tube that defines a portion of the handle;

a second connecting tube that defines a portion of the handle, the second connecting tube being connected to the first connecting tube so as to relatively pivot with respect to the first connecting tube at certain angles; and a locking member that maintains a state in which the second connecting tube has been relatively pivoted with respect to the first connecting tube, wherein corresponding ends of the first and second connecting tubes are provided with a cylindrical connecting/receiving portion and a rotating/connecting portion rotatably received in the connecting/receiving portion, respectively, whereby the second connecting tube is relatively pivoted with respect to the first connecting tube.

16. The upright type vacuum cleaner as claimed in claim 15, wherein the rotating/connecting portion is formed with a through-hole to communicate with the interiors of the first and second connecting tubes.

17. The upright type vacuum cleaner as claimed in claim 15, further comprising a joint cover that covers the connecting/receiving portion of the first connecting tube and the rotating/connecting portion of the second connecting tube, the joint cover being fixed to one of the first and second connecting tubes.

18. An upright type vacuum cleaner, comprising:

a main body with a filtering device that filters out foreign materials entrained in sucked air;

a suction nozzle device connected to a lower portion of the main body to be pivoted on a first joint portion;

a suction force generating device mounted in one of the main body and the suction nozzle device to generate suction force for sucking the air with the entrained foreign materials; and a handle connected to the main body to be pivoted on a second joint portion, and provided with a third joint portion in the handle so that the handle can be folded at certain angles, wherein the handle is configured to be grasped by a user in use, and wherein the third joint portion comprises:

a first connecting tube that defines a portion of the handle;

a second connecting tube that defines a portion of the handle, the second connecting tube being connected to the first connecting tube so as to relatively pivot with respect to the first connecting tube at certain angles; and a locking member that maintains a state in which the second connecting tube has been relatively pivoted with respect to the first connecting tube, and wherein the locking member comprises a cylindrical portion in the form of a ring and a skirt portion extending and flaring from the cylindrical portion, and the skirt portion has locking ribs formed on an inner surface thereof, the locking ribs being fastened to a catching projection provided at one of the first and second connecting tubes at which the locking member is not installed.

19. The upright type vacuum cleaner as claimed in claim 18, wherein the locking member is urged by an elastic member in a direction in which the locking member is caught by the catching projection, and one end of the elastic member is supported in cylindrical portion and the other end thereof is supported by a supporting stopper mounted on an outer circumferential surface of the other of the first and second connecting tubes at which the locking member is installed.

* * * * *